US005924940A

United States Patent [19]

Lucy, Jr.

[11] Patent Number: 5,924,940

[45] Date of Patent: Jul. 20, 1999

[54] INDOOR/OUTDOOR HOPSCOTCH

[76] Inventor: James A. Lucy, Jr., 3013 W. Clinton St., Tampa, Fla. 33614

[21] Appl. No.: 08/824,657

[22] Filed: Mar. 24, 1997

[51] Int. Cl.[6] ..... A63B 67/00

[52] U.S. Cl. ..... 473/414

[58] Field of Search ..... 473/414

[56] References Cited

U.S. PATENT DOCUMENTS

| | | | |
|---|---|---|---|
| D. 174,039 | 2/1955 | Gould | 473/417 |
| 3,008,718 | 11/1961 | Berliner | 473/417 |
| 3,091,454 | 5/1963 | Sam | 473/417 |
| 3,139,281 | 6/1964 | Nicholson | 473/417 |
| 3,515,385 | 6/1970 | Gunderson | 473/417 |
| 3,768,809 | 10/1973 | Ciarfello | 473/417 |
| 4,078,793 | 3/1978 | Allen | 473/417 |
| 4,733,864 | 3/1988 | Castees | 473/417 |
| 5,102,129 | 4/1992 | Roberts | 473/417 |
| 5,156,409 | 10/1992 | Barnes | 473/417 |

*Primary Examiner*—Theatrice Brown

[57] ABSTRACT

The specification relates to a portable hopscotch for playing hopping games indoor or outdoor. The hopscotch made of a single piece of plastic, vinyl or fabric material has distinctively divided and marked small areas on its top surface. The division and marking can be made by lines and numbers, colors, shapes or cartoon characters. The shape of the hopscotch may be made to resemble an animal to make the hopscotch more attractive to children.

1 Claim, 1 Drawing Sheet

Figure 1
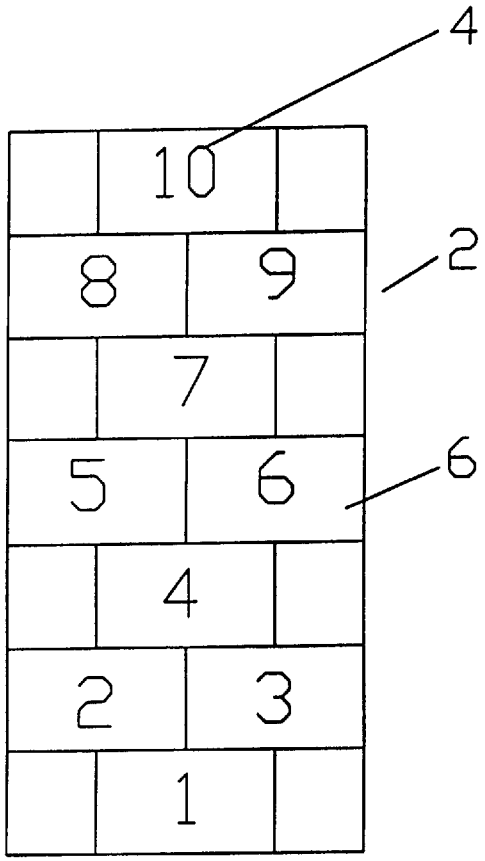
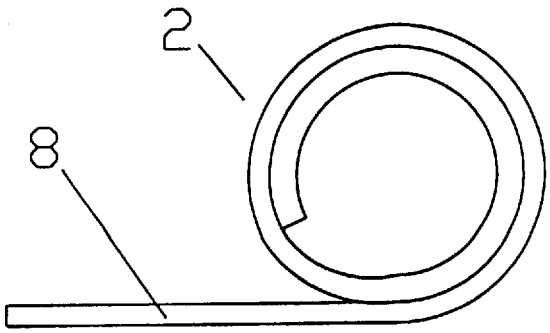
Figure 2

INDOOR/OUTDOOR HOPSCOTCH

BACKGROUND OF THE INVENTION

This invention is concerned with an apparatus for playing hopping games. A hopping game requires a game field, known as "hopscotch", to play. A hopscotch is generally a flat surface divided by lines into areas. Children usually play hopping games on sidewalks, roadsides or any flat ground. When a hopping game is to be played, the common practice is to draw a hopscotch on the ground by a stick, a chalk, a crayon or anything that can form visible lines on the ground. This practice defaces public places. A hopscotch made in this way is not movable and cannot be played during bad weather.

To improve the aforementioned situation, two types of hopscotch have been invented in the past: assembly type and frame type. The assembly type comprises a plurality of mats that can be assembled into a variety of hopscotch for different hopping games. This type is well represented by U.S. Pat. Nos. 1,155,273 issued to Quade and 3,115,340 issued to Stasiuk. The frame type, as disclosed in U.S. Pat. Nos. 2,891,793 to Mudry and 3,345,068 to Bowen, is a single pieced hopscotch comprising only the lines needed for defining the game areas. The drawbacks of the assembly type include the safety concern due to the likely slipping of the small mats, inconvenience in packing and carrying because of the many pieces, and the complexity in assembling a game. The frame type, on the other hand, may be entangled during packing for storage or can not be packed at all. Both types, because of their drawbacks and by their nature, may not be used in a pebbled, jungled or any other unfriendly but flat place. Maybe because of their drawbacks, no hopscotch of either type has been found to be popular so far.

The object of this invention is to provide a portable hopscotch which may be placed on any suitable surface (indoor/outdoor) or even on an imperfect but flat surface such as pebbled or full of foliage to play hopping games without undertaking any fastening or assembling procedure.

Another object of this invention is to provide a hopscotch as a single piece which can be easily packed by rolling or folding and readily portable.

Yet another object of this invention is to provide a single piece hopscotch which has large enough size for anti-slipping to ensure the safety for children hopping on it.

A further object of this invention is to provide a hopscotch which will be easily manufactured from readily available materials.

A still further object of this invention is to provide a hopscotch which has an attractive shape and appearance that is appealing to children.

SUMMARY OF THE INVENTION

To achieve the foregoing and other objects, and in accordance with the purposes of the present invention, as embodied and broadly described herein, the present invention provides a single piece hopscotch comprising a top surface facing up which is distinctively divided into small areas and marked, and a bottom surface facing the ground which may be roughened or patterned to prevent slipping. The division of the top surface may be made by either drawing lines to define each small area or painting each small area with a specific color, shape or cartoon character. The hopscotch of this invention can be manufactured from plastic, vinyl or fabric materials, can be rolled or folded and then packed into a bag to make it readily portable, and can be used to play a hopping game anywhere indoor or outdoor as long as there is a flat area large enough to accommodate the hopscotch. The following figures and description show, but are by no means limited to, a hopscotch with ten (10) divided areas to illustrate the present invention.

BRIEF DESCRIPTION OF THE DRAWINGS

FIG. 1 is the top view of a indoor/outdoor hopscotch with ten (10) divided areas.

FIG. 2 is the side view of the same hopscotch when it is rolled.

DESCRIPTION OF THE PREFERRED EMBODIMENT

FIG. 1, shows the top surface of one of the most popular hopscotch with ten (10) boxes. FIG. 2 illustrates the same hopscotch being rolled. In the figures, 2 is the hopscotch, 4 is the large bold letters to mark each box distinctively, 6 is the boxes with number, and 8 indicates the hopscotch being made of plastic, vinyl or fabric materials. The numbered area, instead of being numbered, may also be painted with different colors, shapes or cartoon characters to make the game more appealing to children. The extra areas (areas without number as shown in FIG. 1) in the hopscotch may or may not be cut off. By cutting off some of the extra areas and adding some other extra areas, one can also make the whole hopscotch in the shape of an alligator, a lizard, or any one of other animals. This will further make the game more attractive to children. The areas on the hopscotch may be defined either by lines and numbers, or by different colors. The flexibility in making the top surface of a hopscotch as described hereto is generally applicable to any hopscotch or hopping game.

The other surface of the hopscotch facing the ground (not shown in the figures) may be roughened or patterned, if needed, to increase friction so that the hopscotch will stay firmly on the ground without slipping for a child to hop on it. Typical patterns can be waver, hatch, daisy, and so on. Such constructed hopscotch may be used to play hopping games on any flat ground such as a sidewalk, a roadside, a driveway, the beach, a picnic place, a floor in a room or a basement, or even a pebbled or foliaged area. The hopscotch may be rolled or folded into a compact size and packed into a bag. A complete hopping game also comprises a puck in about two (2) square inches and made by plastic, wood, metal or any other solid materials.

An example of a hopscotch is a rectangular mat having ten boxes divided by lines (as shown in FIG. 1). The boxes are consecutively marked 1, 2, 3, . . . and 10 by bold faced numbers from one end to the other end of the hopscotch along its long dimension. The hopscotch is seven (7) feet long and two (2) feet wide. Each box is a square with one (1) foot on each side. The hopscotch can be manufactured by plastic or vinyl material, and is made to be folded at each 21"

along the long dimension so that the whole hopscotch can be folded into a 24"×21" rectangular pack. A bag of compatible size is used to contain the folded hopscotch for carriage and storage. The game also comprises a plastic puck in the size of 1.2"×1.7". The puck is also packed in the same bag containing the hopscotch.

What is claimed is:

1. A portable game for playing hopscotch formed of a single piece of flexible material selected from a group consisting of plastics, vinyl and fabrics, adapted to be placed on a flat ground surface for playing a hopping game, said game for playing hopscotch comprising (a) a top surface facing up which is distinctively divided into small areas by means selected from a group consisting of lines, colors, shapes and cartoon characters, said top surface being divided into ten equally sized fixed rectangular boxes by lines, said boxes being arranged in seven rows aligned along the long dimension with alternatively one box and two boxes in each row, said boxes being consecutively marked with numbers one through ten; and (b) a bottom surface opposite to the top surface and facing to the ground, said bottom surface being roughened with a wavered pattern to make it non-slipping;

(c) wherein said single piece of material being disposed in a rolled orientation when not in use.

* * * * *